US012089759B1

(12) United States Patent
Jackson

(10) Patent No.: US 12,089,759 B1
(45) Date of Patent: Sep. 17, 2024

(54) ARM-MOUNTED BEVERAGE HOLDER

(71) Applicant: Lawrence Jackson, Matthews, NC (US)

(72) Inventor: Lawrence Jackson, Matthews, NC (US)

( * ) Notice: Subject to any disclaimer, the term of this patent is extended or adjusted under 35 U.S.C. 154(b) by 135 days.

(21) Appl. No.: 17/963,253

(22) Filed: Oct. 11, 2022

(51) Int. Cl.
*A47G 23/06* (2006.01)
*A45F 3/16* (2006.01)
*A45F 5/00* (2006.01)
*A47G 23/08* (2006.01)

(52) U.S. Cl.
CPC ..... *A47G 23/0641* (2013.01)

(58) Field of Classification Search
CPC ..... A47G 23/0641; A47G 23/08; A47G 23/0616; A47G 23/0625; A47G 2200/046; A45F 3/16; A45F 2200/0583; A45F 2005/008
USPC ..... 224/148.4, 148.7, 148.1, 218, 219, 220, 224/221, 222; 220/914; 108/43
See application file for complete search history.

(56) References Cited

U.S. PATENT DOCUMENTS 1,005,235 A * 10/1911 Langguth ..... A45F 5/10 211/74
3,142,425 A * 7/1964 Cobb ..... A47G 23/065 D7/543
3,162,344 A * 12/1964 Sabol ..... A47G 23/0625 D7/553.6
3,273,766 A * 9/1966 Cosentino ..... A44C 5/0046 362/396
3,504,832 A * 4/1970 Corvetti ..... B60N 3/002 220/574
3,964,629 A * 6/1976 McCabe ..... A47G 23/0208 215/396
D285,638 S * 9/1986 Trivison ..... A47F 5/05 D7/557
4,643,104 A * 2/1987 Rasmussen ..... A47F 5/05 108/147.11
D292,161 S * 10/1987 Spolter ..... D7/553.6
5,299,695 A * 4/1994 Taylor, Jr. ..... A47G 23/08 211/77
5,573,136 A * 11/1996 Page ..... A47G 23/0616 220/761
6,131,779 A * 10/2000 Gendala ..... A45F 5/02 248/312.1

(Continued)

FOREIGN PATENT DOCUMENTS

GB 191006239 A * 7/1910
WO 2011107786 9/2011

OTHER PUBLICATIONS

CN-203074123-U; Zheng, L.; China; Jul. 24, 2013 (Year: 2013).*

*Primary Examiner* — Nathan J Newhouse
*Assistant Examiner* — Lester L Vanterpool
(74) *Attorney, Agent, or Firm* — Kyle A. Fletcher, Esq.

(57) ABSTRACT

The arm-mounted beverage holder comprises a drink carousel, and an arm mount. The arm-mounted beverage holder may be adapted to be worn by a server on the server's forearm. The drink carousel may be configured to carry one or more beverages. The arm mount may be adapted to detachably couple to the server's forearm. The arm-mounted beverage holder may be adapted to enable the server to carry the one or more beverages to one or more customers on the server's forearm and to serve an individual beverage to an individual customer using a free hand.

11 Claims, 4 Drawing Sheets

(56) References Cited

U.S. PATENT DOCUMENTS 6,352,235 B2 * 3/2002 Cizek ..... B65D 23/106 81/3.4
6,520,366 B1 * 2/2003 Bradley ..... A47G 19/065 220/23.6
7,243,786 B2 7/2007 Sollazzo
D624,360 S * 9/2010 Leavelle ..... B65D 25/20 D7/553.6
D628,793 S * 12/2010 Furlough ..... A47B 43/00 D3/229
8,272,512 B2 9/2012 Joseph
8,402,901 B1 * 3/2013 Bahnsen ..... A47B 43/00 99/426
8,544,390 B1 * 10/2013 Bahnsen ..... F16B 12/26 248/349.1
8,794,686 B2 8/2014 Grieve
8,973,796 B1 * 3/2015 Abusaoud ..... B65D 1/34 224/222
D766,665 S * 9/2016 Shames ..... D7/554.2
D770,870 S * 11/2016 Nash ..... B65D 25/20 D7/551.1
10,098,443 B2 * 10/2018 Butler ..... A45F 3/20
10,617,247 B1 * 4/2020 Galdun ..... A47G 23/0216
D910,364 S * 2/2021 Huckestein ..... D7/357
D919,353 S * 5/2021 Young ..... D7/357
D925,292 S 7/2021 Abusoud
D931,061 S * 9/2021 Ferrada ..... D7/611
D945,830 S * 3/2022 Lipert ..... D7/552.1
D964,812 S * 9/2022 Zhong ..... D7/600.1
11,564,477 B1 * 1/2023 Chao ..... B65D 71/50
2002/0170868 A1 * 11/2002 Morgan ..... A47G 23/08 211/163
2004/0251283 A1 * 12/2004 McGuyer ..... A47G 23/08 222/537
2007/0215512 A1 9/2007 Belissimo
2008/0078791 A1 * 4/2008 Toce ..... A45F 5/00 224/222
2008/0128440 A1 * 6/2008 Braams ..... A47G 23/0641 220/737
2010/0059559 A1 * 3/2010 Given ..... A45F 5/00 224/267
2010/0116704 A1 * 5/2010 Longley ..... A47G 23/0208 206/427
2010/0230419 A1 * 9/2010 Joseph ..... A47G 23/0625 220/574
2010/0301077 A1 * 12/2010 Robertson ..... G09F 23/06 283/56
2012/0106158 A1 5/2012 Vaessen
2014/0217256 A1 * 8/2014 Young ..... A45F 5/00 248/311.2
2015/0069096 A1 * 3/2015 Kampas ..... A45F 5/00 224/148.6
2015/0230643 A1 8/2015 Kamei
2016/0143469 A1 * 5/2016 Higgins ..... A47B 13/16 220/737
2020/0087044 A1 * 3/2020 Weiksnar ..... B65D 25/20
2022/0110469 A1 * 4/2022 Barksdale ..... A47G 23/0683
2022/0257038 A1 * 8/2022 Bettinger ..... F16B 2/08

* cited by examiner

ARM-MOUNTED BEVERAGE HOLDER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of beverage carriers, more specifically, an arm-mounted beverage holder.

SUMMARY OF INVENTION

The arm-mounted beverage holder comprises a drink carousel, and an arm mount. The arm-mounted beverage holder may be adapted to be worn by a server on the server's forearm. The drink carousel may be configured to carry one or more beverages. The arm mount may be adapted to detachably couple to the server's forearm. The arm-mounted beverage holder may be adapted to enable the server to carry the one or more beverages to one or more customers on the server's forearm and to serve an individual beverage to an individual customer using a free hand.

An object of the invention is to provide a beverage holder capable of carrying a plurality of beverages.

Another object of the invention is to provide an arm mount adapted to detachably couple to a server's forearm.

A further object of the invention is to provide a drink carousel supported around an arm of the server.

These together with additional objects, features and advantages of the arm-mounted beverage holder will be readily apparent to those of ordinary skill in the art upon reading the following detailed description of the presently preferred, but nonetheless illustrative, embodiments when taken in conjunction with the accompanying drawings.

In this respect, before explaining the current embodiments of the arm-mounted beverage holder in detail, it is to be understood that the arm-mounted beverage holder is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the arm-mounted beverage holder.

It is therefore important that the claims be regarded as including such equivalent construction insofar as they do not depart from the spirit and scope of the arm-mounted beverage holder. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not 8 necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
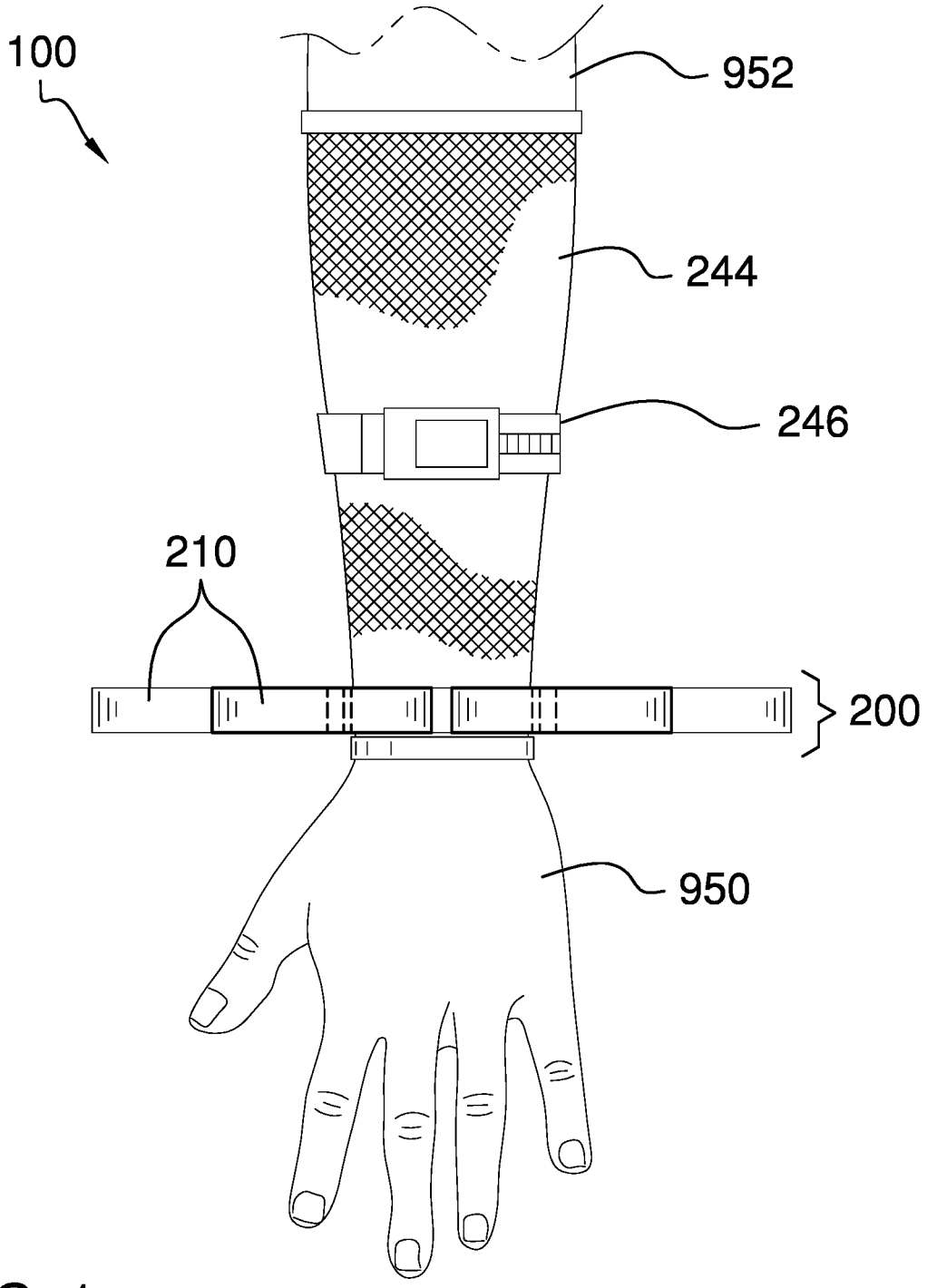
FIG. 1 is a top view of an embodiment of the disclosure.
Figure 2:
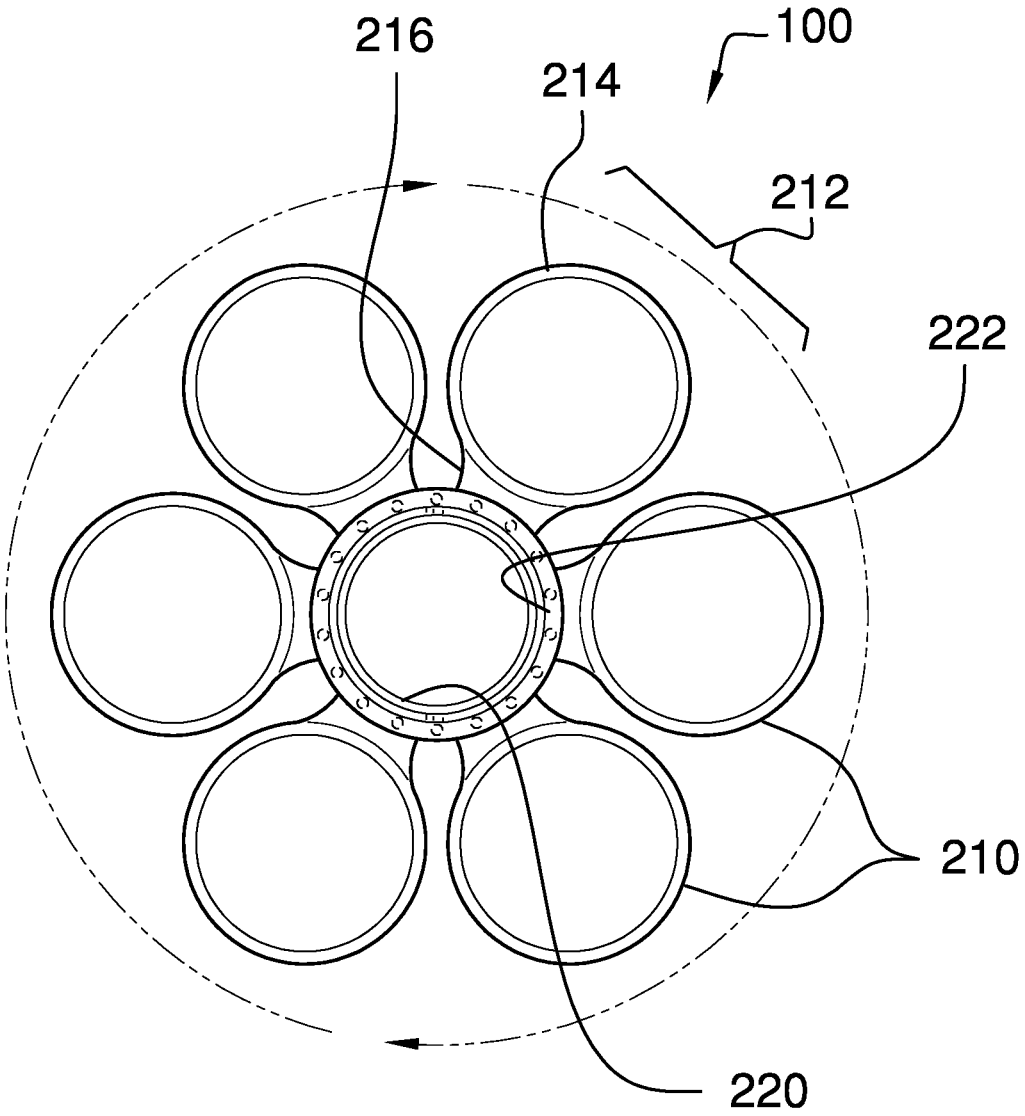
FIG. 2 is a top view of an embodiment of the disclosure illustrating the drink carousel rotated 90 degrees from the position shown in FIG. 1.
Figure 3:
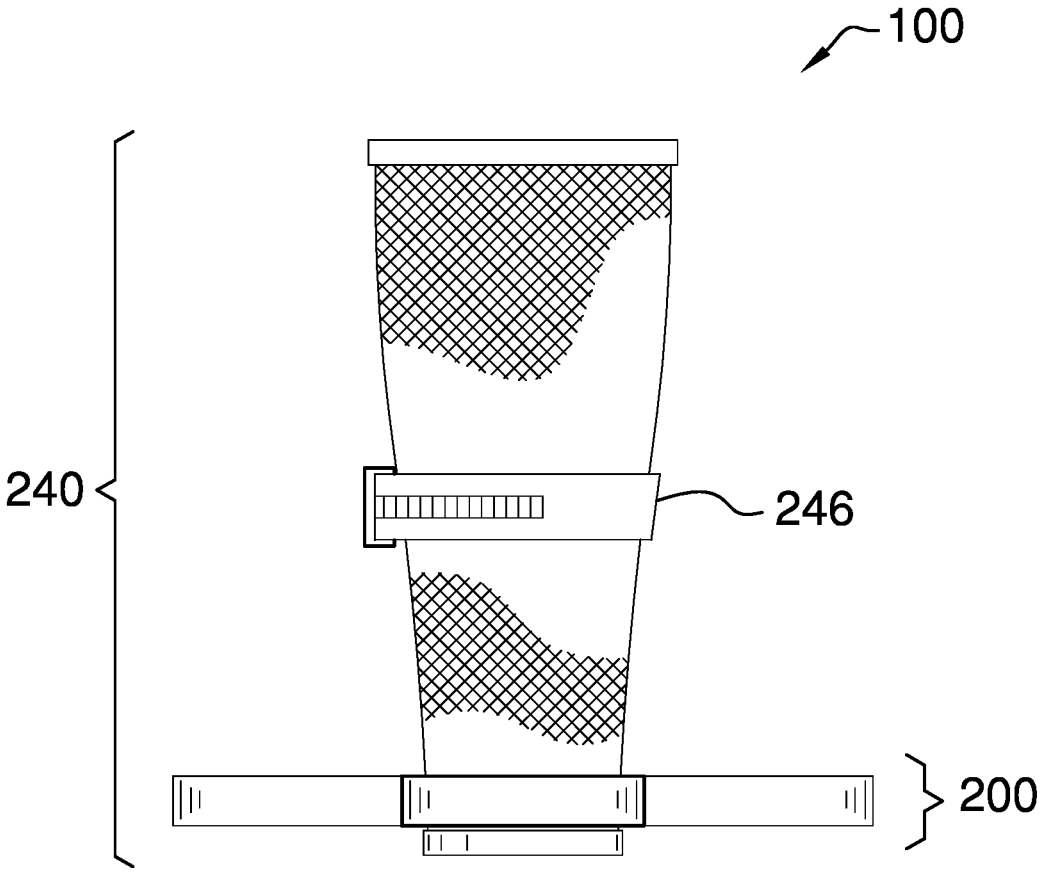
FIG. 3 is a front view of an embodiment of the disclosure.
Figure 4:
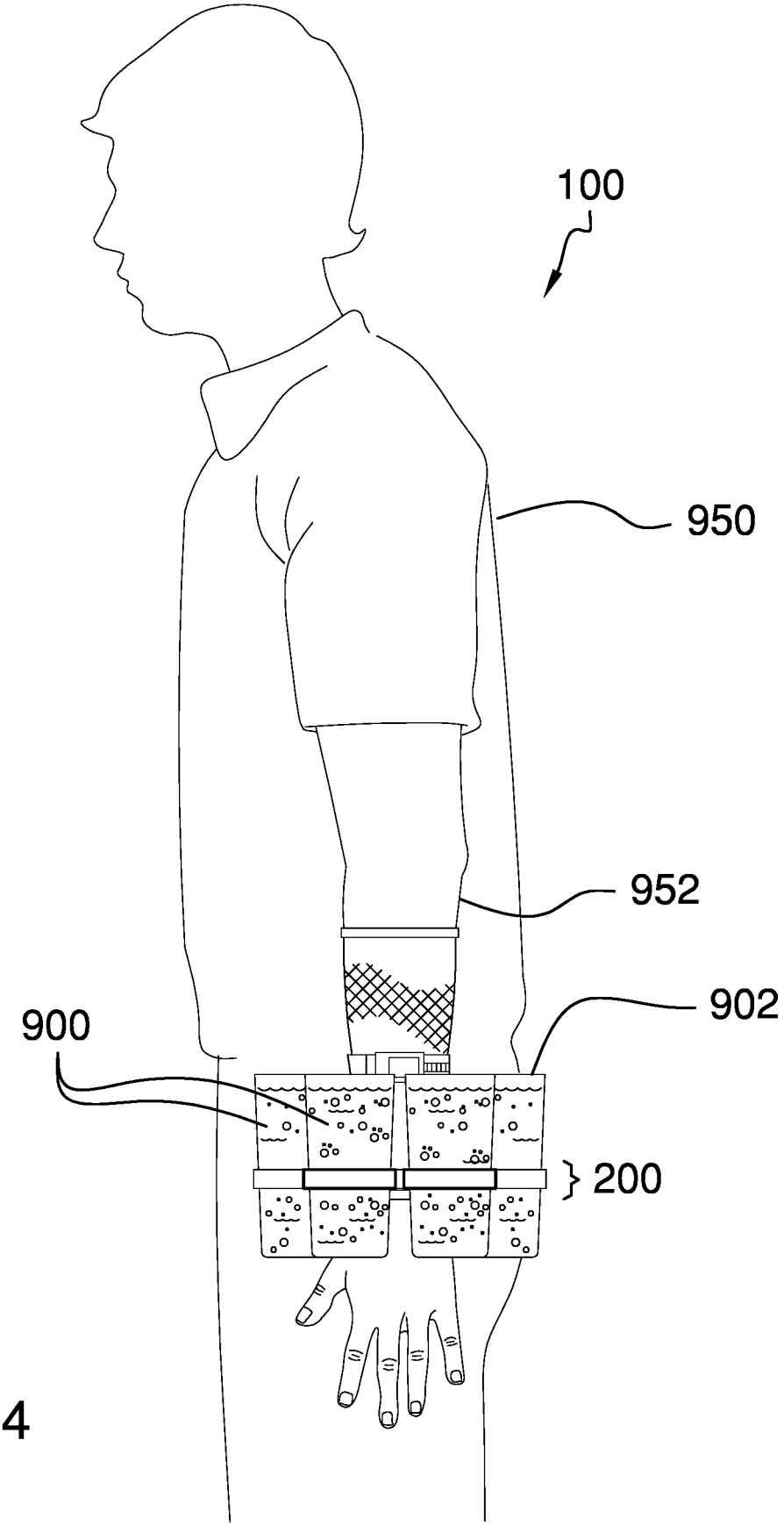
FIG. 4 is an in-use view of an embodiment of the disclosure.

Detailed reference will now be made to a first potential embodiment of the disclosure, which is illustrated in FIGS. 1 through 4.

The arm-mounted beverage holder 100 (hereinafter invention) comprises a drink carousel 200, and an arm mount 240. The invention 100 may be adapted to be worn by a server 950 on the server's forearm 952. The drink carousel 200 may be configured to carry one or more beverages 900. The arm mount 240 may be adapted to detachably couple to the server's forearm 952. The arm mount 240 may support the drink carousel 200. The invention 100 may be adapted to enable the server 950 to carry the one or more beverages 900 to one or more customers on the server's forearm 952 and to serve an individual beverage to an individual customer using a free hand. The invention 100 is oriented horizontally while having the server's forearm 952 vertically 8 oriented.

The drink carousel 200 may comprise a plurality of cup holders 210 and a hub 220. The plurality of cup holders 210 may 12 be coupled to the hub 220 around the periphery of the hub 220 such that the plurality of cup holders 210 are coplanar. An 14 individual cup holder 212 may comprise a cup ring 214 and a cup arm 216. The cup ring 214 may be an armature in the shape of an annulus. During use, the cup ring 214 may be retained in a horizontal orientation such that a cup 902 may be inserted from the top through the central opening of the cup ring 214. One end of the cup arm 216 may be coupled to the cup ring 214 and the opposite end of the cup arm 216 may be coupled to the hub 220.

The hub 220 may be a plate that supports the cup rings 214. The bottom center of the hub 220 may comprise a turntable bearing 222. Both the arm mount 240 and the hub 220 may pivotably couple to the drink carousel 200 via the turntable bearing 222 such that the drink carousel 200 may rotate with respect to the hub 220 and the arm mount 240.

The top center area of the hub 220 may comprise indicia 228. As non-limiting examples, the indicia 228 may be silk-screened, embossed, printed, painted, decaled, molded, etched, or any combination thereof. As non-limiting examples, the indicia 228 may be a logo, company name, product brand name, details of an event, or any combination thereof.

The arm mount 240 may comprise a sleeve 244. The sleeve may be a tube of a mesh fabric that may be adapted to stretch to cling to the server's forearm 952. The sleeve 244 may be adapted to increase friction between the server's forearm 952 and the hub 220 to prevent the hub 220 from spinning around the server's forearm 952.

The arm mount 240 may further comprise a ratcheting belt 246. The ratcheting belt 246 may be an adjustable band that is adapted to encircle the server's forearm 952. The ratcheting belt 246 may be tightened to prevent movement of the sleeve 244 and the ratcheting belt 246 may be loosened for donning and removal.

The invention 100 may be donned by sliding the sleeve 244 onto the server's forearm 952, sliding the ratcheting belt 246 over the sleeve 244. The ratcheting belt 246 may be tightened to prevent movement of the sleeve 244.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting 18 example, the upper end of a vertical shaft is the top end of the 19 vertical shaft.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

As used in this disclosure, a "bearing" may be anything that holds a rotating or sliding shaft or tube. A bearing may guide a moving component, limit the motion of a moving component relative to a fixed component and/or reduce the friction between the moving component and the fixed component.

As used in this disclosure, a "beverage" may be a liquid that is intended for consumption by a person.

As used herein, the words "couple", "couples", "coupled" or "coupling", may refer to connecting, either directly or indirectly, and does not necessarily imply a mechanical connection.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, the term "indicia" may refer to a set of markings that identify a sentiment.

As used in this disclosure, a "logo" may be artwork that is typically associated with an organization, brand, or activity. The logo may be textual, graphical, or both.

As used in this disclosure, the term "mesh" may refer to an openwork fabric made from threads, yarns, cords, wires, strands, or lines that are woven, knotted, twisted, or otherwise intertwined at regular intervals. A mesh may also be referred to as a net.

As used in this disclosure, "orientation" may refer to the positioning and/or angular alignment of a first object relative to a second object or relative to a reference position or reference direction.

As used herein, the words "painted" or "tinted" may refer to a change of coloration produced using paint, ink, dyes, or other coloring agents. The method of producing such a coloration change may include pens, brushes, stamps, stencils, or other methods of applying a coloring agent.

As used in this disclosure, a "pedestal" may be an intermediary load bearing structure that is placed between a supporting surface and an object, structure, or load.

As used herein, the words "printed", "marked", and "marking" may refer to a mark that has been made on an object. The process of making the mark may involve printing, lithography, thermal transfer, painting, embossing, molding, burning, silk-screening, drawing, etching, engraving, stenciling, stamping, spraying of pigments, or other processes which result in the controlled change of coloration and/or shape of a surface.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An arm-mounted beverage holder comprising:

a drink carousel, and an arm mount;

wherein the arm-mounted beverage holder is adapted to be worn by a server on the server's forearm;

wherein the drink carousel is configured to carry one or more beverages;

wherein the arm mount is adapted to detachably couple to the server's forearm;

wherein the arm mount supports the drink carousel;

wherein the arm-mounted beverage holder is adapted to enable the server to carry the one or more beverages to one or more customers on the server's forearm and to serve an individual beverage to an individual customer using a free hand;

wherein the arm-mounted beverage holder is oriented horizontally while having the server's forearm adapted to be vertically oriented;

wherein the drink carousel comprises a plurality of cup holders and a hub;

wherein the plurality of cup holders are coupled to the hub around the periphery of the hub such that the plurality of cup holders are coplanar;

wherein an individual cup holder comprises a cup ring and a cup arm;

wherein the cup ring is an armature in the shape of an annulus.

2. The arm-mounted beverage holder according to claim 1 wherein during use, the cup ring is retained in a horizontal orientation such that a cup is inserted from the top through the central opening of the cup ring.

3. The arm-mounted beverage holder according to claim 2 wherein one end of the cup arm is coupled to the cup ring and the opposite end of the cup arm is coupled to the hub.

4. The arm-mounted beverage holder according to claim 3 wherein the hub is a plate that supports the cup rings;

wherein the bottom center of the hub comprises a turntable bearing;

wherein the hub and the arm mount are pivotably coupled to the drink carousel via the turntable bearing such that the drink carousel rotates about both the hub and the arm mount.

5. The arm-mounted beverage holder according to claim 4 wherein the top center area of the hub comprises indicia.

6. The arm-mounted beverage holder according to claim 5 wherein the indicia is silk-screened, embossed, printed, painted, decaled, molded, etched, or any combination thereof.

7. The arm-mounted beverage holder according to claim 6 wherein the indicia is a logo, company name, product brand name, details of an event, or any combination thereof.

8. The arm-mounted beverage holder according to claim 4 wherein the arm mount comprises a sleeve.

9. The arm-mounted beverage holder according to claim 8 wherein the sleeve is a tube of a mesh fabric that is adapted to stretch to cling to the server's forearm;

wherein the sleeve is adapted to increase friction between the server's forearm and the hub to prevent the hub from spinning around the server's forearm.

10. The arm-mounted beverage holder according to claim 9 wherein the arm mount further comprises a ratcheting belt;

wherein the ratcheting belt is an adjustable band that is adapted to encircle the server's forearm;

wherein the ratcheting belt is tightened to prevent movement of the sleeve and the ratcheting belt is loosened for donning and removal.

11. The arm-mounted beverage holder according to claim 10 wherein the arm-mounted beverage holder is adapted to be donned by sliding the sleeve onto the server's forearm, sliding the ratcheting belt over the sleeve;

wherein the ratcheting belt is position adjacent to the arm ring and the ratcheting belt is tightened to prevent movement of the sleeve.

* * * * *